US005680660A

United States Patent [19]

Johanknecht

[11] Patent Number: 5,680,660

[45] Date of Patent: Oct. 28, 1997

[54] BLANKET SUPPORT WITH UPWARDLY OR DOWNWARDLY PIVOTABLE LEG

[76] Inventor: Edwin Johanknecht, 4335 Tanglewood S., Apt. 270, Palm Beach Gardens, Fla. 33410

[21] Appl. No.: 757,434

[22] Filed: Nov. 27, 1996

[51] Int. Cl.[6] ..... A47C 21/02

[52] U.S. Cl. ..... 5/504.1; 5/505.1

[58] Field of Search ..... 5/504.1, 505.1, 5/506.1, 503.1, 507.1, 658

[56] References Cited

U.S. PATENT DOCUMENTS

| | | | |
|---|---|---|---|
| 2,562,333 | 7/1951 | Ries | 5/504.1 |
| 2,979,736 | 4/1961 | Kemman | 5/504.1 |
| 3,435,469 | 4/1969 | Fricke | 5/504.1 |
| 3,885,256 | 5/1975 | Du Boff | 5/504.1 |
| 5,305,480 | 4/1994 | Loren et al. | 5/504.1 |

*Primary Examiner*—Alexander Grosz
*Attorney, Agent, or Firm*—McHale & Slavin

[57] ABSTRACT

A blanket support device slidably insertable between the mattress and box spring of a conventional bed. The blanket support device extends outward from the mattress providing a surface area for placement of blankets thereon. A leg support is formed integral and hingeably secured thereto to maintain the blanket support in a horizontal position should blankets of heavy material be placed thereon. The leg support is adaptable to different size beds by trimming a portion of the leg support along a pre-defined location. The leg support may also be rotated into an upward position providing a blanket support so as to raise the blanket above an individual's feet during the sleeping process. The blanket support device is stored by placement of the leg support into a horizontal position allowing insertion between the mattress and box spring.

9 Claims, 2 Drawing Sheets

BLANKET SUPPORT WITH UPWARDLY OR DOWNWARDLY PIVOTABLE LEG

FIELD OF THE INVENTION

This invention relates to bedding materials and in particular to a blanket support for supporting blankets in a storage position, or alternatively operating as a blanket stand.

BACKGROUND OF THE INVENTION

Blankets are commonly used to keep an individual warm at night while resting in bed. The need for a blanket varies with the time of year requiring storage during non-use yet ease of accessibility when needed. It is advantageous to maintain the blanket in close proximity to the bed should the individual become cold during the night. In addition, blankets detract from the formal appearance of bedding when not in use and may be removed during the day for aesthetic purposes. In either event, it is preferable that the blanket remains in close proximity to the bedding for ease of retrieval. In many instances the blanket may be placed at the end or corner of a bed for storage. The disadvantage to such storage locations is the ability of an individual to accidently push the blanket off the bedding during the sleep process. Placing the blanket on a dresser top may also be inconvenient as the blanket may detract from the placement of other articles.

Blankets can cause problems during the sleep process, especially those constructed of a dense heavy material. For some individuals the use of a heavy blanket is necessary but most annoying if the blanket touches their feet. U.S. Pat. No. 4,214,327, discloses a blanket support that raises the blanket above the feet of the sleeping individual for a comfortable sleeping arrangement. While the option of having a blanket rest on the toes of an individual is a personal preference, there are certain medical situations that demand that no contact with a blanket occurs, especially if an injury or disease to the feet has occurred.

Thus, what is lacking in the art is a blanket support device capable of storing blankets at the foot of a bed when not in use, as well as operating as a blanket stand so as to inhibit a blanket from contacting the feet of an individual. The blanket support should be inexpensive to manufacture, adjustable to various size beds, and easily concealable when not in use.

SUMMARY OF THE INVENTION

The instant invention is a blanket support device consisting of a rectangular piece of rigid material that is slidably insertable between the mattress and box spring of a bed. The device is inserted between the mattress and box spring at the foot of a bed. The blanket support device can be slid out from its storage position wherein a blanket can be placed onto the upper surface.

Should the blanket be constructed of a weighted material, the device may include a leg support formed integrally to the blanket support device. The leg support provides a stand to maintain the support device in a horizontal position to the mattress, despite the weight of the blankets. In this manner, the blanket support may secure multiple blankets or be extended outward further from the mattress for support of larger blankets.

The leg support further operates as an inverted stand upon rotation of the leg into an upward position. Upon positioning the device at an edge of a mattress, the leg support extends upward over the top of the bed providing a blanket stand. The stand maintains a blanket over the surface of a bed at a height above the toes of an individual laying on the bed. Placement of a blanket over the stand inhibits an individual from contacting the blanket with their toes.

The leg support is adjusted to fit various heights of beds by trimming an end of the leg along various pre-defined cut lines. When the leg support is not in use, the leg support can be replaced into the predefined cutout section and slid between the mattresses for complete concealment. This storage position does not affect sleeping as the weight of the individual's body at the edge of a bed will not result in measurable compression that requires support of the lower mattress. The device simply does not insert far enough between the mattresses so as to cause interference with the individual's body weight and required support by the box spring.

The support platform includes a hand hold so as to allow an individual ability to easily insert or remove the device from the storage position. In addition, a lip may be provided on one edge of the device to prevent over-insertion as well as prevent blankets from sliding off the support.

Thus, an objective of the invention is to provide an inexpensive blanket support that is easily concealable when not in use.

Yet another objective of the instant invention is to disclose a multi-purpose blanket support having provisions for supporting of blankets constructed from heavy materials by use of a leg support as well as operate a blanket support for extending a blanket above the toes of an individual by reverse positioning of said leg support.

Still another objective of the instant invention is to disclose a blanket support that is adjustable for bedding material having various heights above a support floor.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention will be described in terms of specific embodiments, it will be readily apparent to those skilled in this art that various modifications, rearrangements and substitutions can be made without departing from the spirit of the invention. The scope of the invention is defined by the claims appended hereto.

Figure 1:
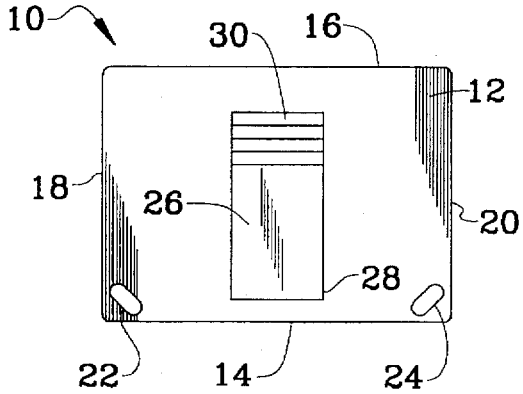
FIG. 1 is a top plane view of the blanket support device of the instant invention.

Now referring to FIG. 1, illustrated is the blanket support device instant invention 10 consisting of a rectangular support platform constructed from a single piece of rigid material, preferably lightweight plastic, having an upper surface 12 with a front edge 14, a back edge 16, and side edges 18 and 20. The blanket support is of nominal thickness having at least one through hole, and preferably multiple through holes as depicted by numeral 22 and 24, which allows ease of grasping the device for purposes of insertion or removal from a storage position.

In an embodiment of the invention, a leg support 26 is formed integral to the support platform and hingedly attached. Preferably the hinge mechanism is a two way living hinge 28 allowing the leg support 26 to be placed in a perpendicular position either above or below surface 12. On one end 30 of the leg support is a plurality of cut lines that allow for individual adjustment of the leg support to accommodate various sized beds.

Figure 2:
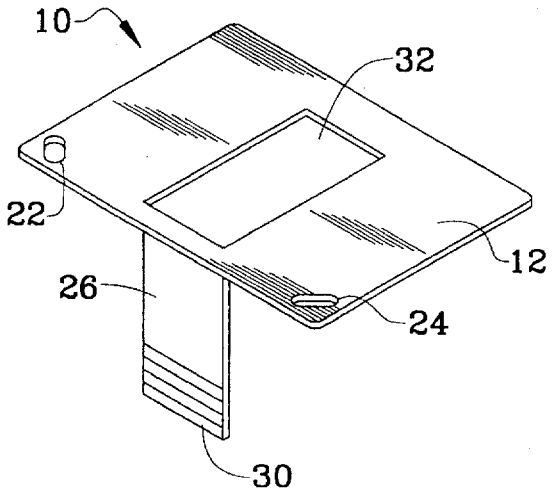
FIG. 2 is a perspective view of the blanket support device illustrating the support leg placed in a downward position.

As shown in FIG. 2, the device 10 is illustrated with leg support 26 placed perpendicular to the upper surface 12. The leg support 26 may be adjusted to accommodate a bed by removal of individual pieces along end 30 to maintain a particular height. It is noted that placement of the leg support 26 in an operable position creates opening 32, but that the opening is small enough to inhibit a blanket from falling through the opening.

Figure 3:
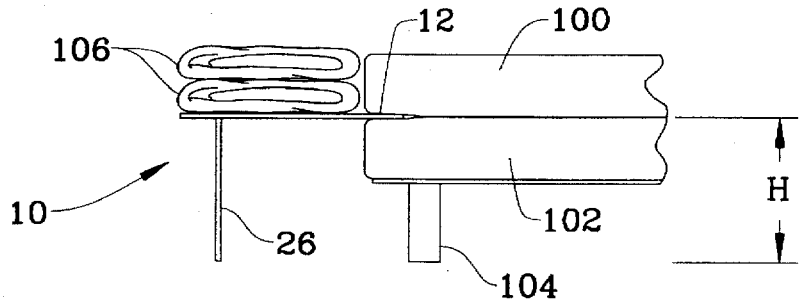
FIG. 3 is a pictorial view of the blanket support device having blankets placed thereon.

Operation of the device 10 is shown in FIG. 3 wherein the blanket support device 10 is slid out from between the mattress and box spring 100 and 102. The leg support 26 is placed in a perpendicular position to surface 12 and initially adjusted to accommodate the height of legs 104 and lower mattress 102 relative to the overall "H" height. Blankets 106 are shown placed in a stored position on surface 12. In many instances the leg support 26 is not necessary and may be eliminated. The leg support simply allow the size of the blanket support to be reduced or support heavier materials.

Figure 4:
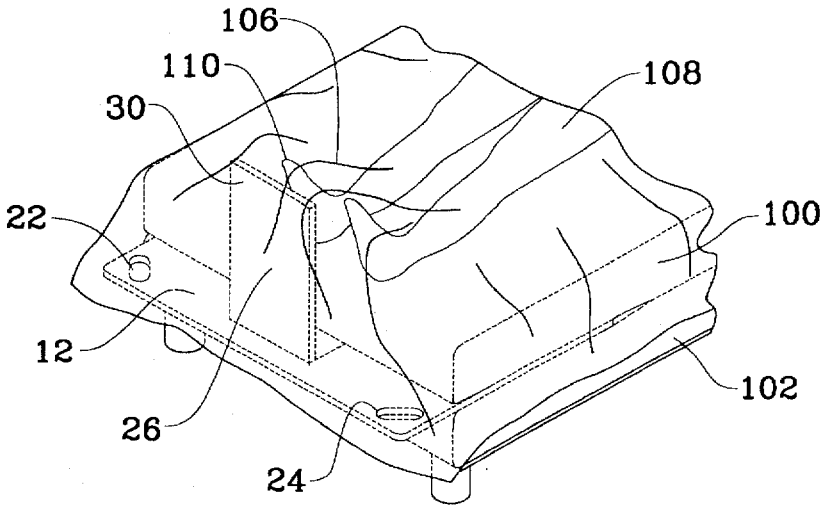
FIG. 4 is a pictorial view of the blanket support device with the support leg in an inverted position having a blanket positioned above the feet of an individual.

FIG. 4 is a pictorial view of the blanket support device 10 with leg support 26 in an upright perpendicular position wherein the blanket 106 extends over an individual 108 with the end 30 of the leg support 26 maintaining the blanket 106 at a position above the feet 110 of the individual 108. Handle holes 22 and 24 are depicted providing ease of access for insertion or removal of the device from a position between mattress 102 and box spring 100.

Figure 5:
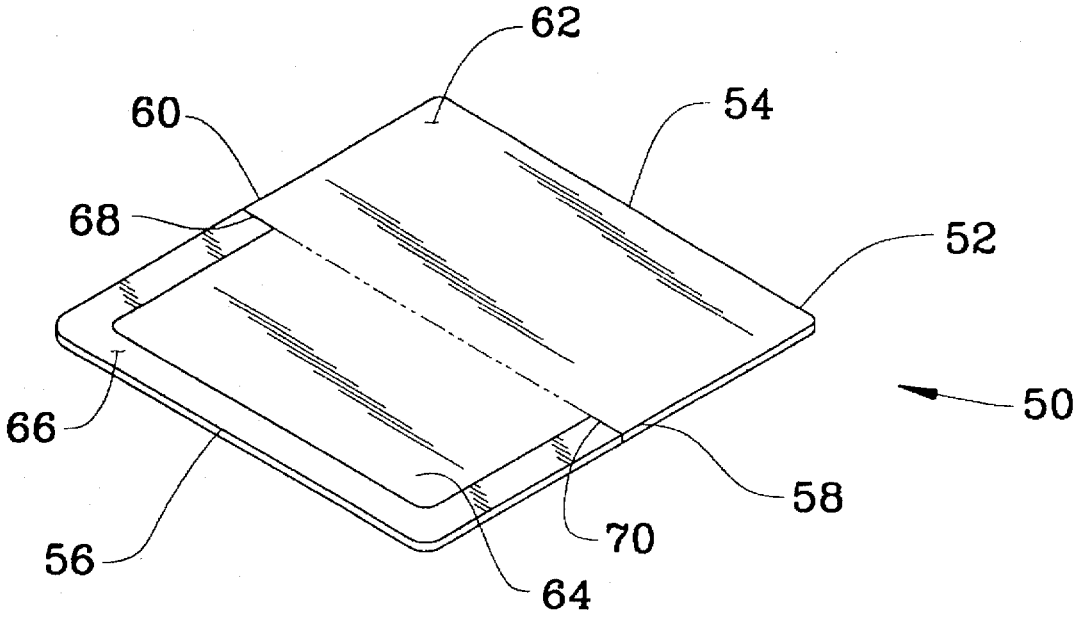
FIG. 5 is a top view of a second embodiment of the blanket support device having a perimeter portioned leg support.

FIG. 5 is a top view of a second embodiment of the blanket support device a rectangular shaped rigid support platform 52 of nominal thickness having a front edge 54, a back edge 56, opposing side edges 58 and 60 and an upper surface 62 with a lower surface, not shown. In this embodiment, the front edge is slidably insertable between a mattress and a box spring on a bed whereby partial removal of the support platform exposes section 64 providing a platform for placement of a blanket thereon. In addition, perimeter leg 66 is moveable in an upward or downward position along hinge sections 68 and 70 should a leg support be needed to either maintain section 64 in a horizontal position or for use as a blanket stand.

Figure 6:
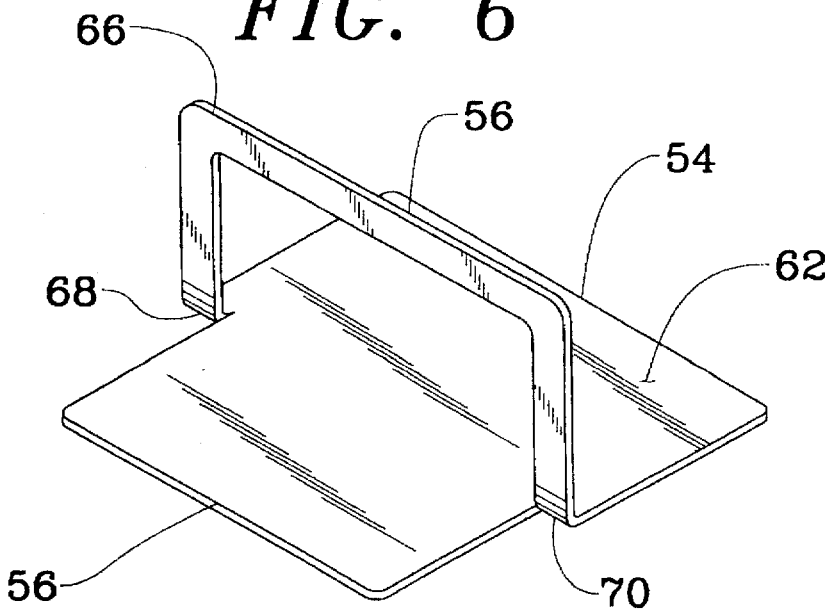
FIG. 6 is a perspective view of the blanket support device of FIG. 5 illustrating the support leg placed in an upward position.

FIG. 6 is a perspective view of the blanket support device of FIG. 5 illustrating the support leg 66 placed in an upward position. The perimeter placement of the leg permits a large area for use as a blanket stand should more than one individual lying on the bed be in need of a blanket stand to prevent blanket contact with their feet. In this manner the perimeter edge is rotated either above or below the surface 62 of the platform along hinge line 68 and 70. The perimeter leg 66 may also frictional engage the support platform to maintain the perimeter leg in a locked position for ease of insertion between the mattress and box spring or when a support leg is not needed.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A blanket support device comprising;

a rectangular shaped rigid support platform of nominal thickness having a front edge, a back edge, opposing side edges and an upper and lower surface; and a centrally disposed leg support means having a first end and second end, said first end coupled to said support platform by a hinge means; wherein said support platform is slidably insertable between a mattress and a box spring on a bed whereby partial removal of said support platform allows said leg support to be placed perpendicular to said lower surface of said support platform to support said platform in a horizontal position, thereby providing a platform for placement of a blanket thereon with said leg support also positionable perpendicular to said upper surface of said support platform for maintainig a blanket above the feet of an individual lying in a bed.

2. The blanket support device according to claim 1 wherein said hinge means is defined as a living hinge.

3. The blanket support device according to claim 1 wherein said material is plastic.

4. The blanket support device according to claim 1 wherein said second end includes a plurality of cut-lines providing ease of material removal for shortening the length of said leg support.

5. The blanket support device according to claim 1 including a least one through hole providing a hand hold to assist in movement of said support platform.

6. A blanket support device comprising:

a rectangular shaped rigid plastic support platform of nominal thickness having a front edge, a back edge, opposing side edges and an upper and lower surface; and a leg support means formed integral to said support platform positioned along a perimeter edge of said back edge, said leg support means having a first end and a second end, said first end coupled to said support platform by a hinge means; wherein said support platform is slidably insertable between a mattress and a box spring on a bed whereby partial removal of said support platform allows said leg support to be placed perpendicular to said lower surface of said support platform to support said platform in a horizontal position, thereby providing a platform for placement of a blanket thereon with said leg support also positionable perpendicular to said upper surface of said support platform for maintaining a blanket above the feet an individual lying in a bed.

7. The blanket support device according to claim 6 wherein said hinge means is defined as a living hinge.

8. The blanket support device according to claim 6 wherein said second end includes a plurality of cut-lines providing ease of material removal for shortening the length of said leg support.

9. The blanket support device according to claim 6 including at least one through hole providing a hand hold to assist in movement of said support platform.

* * * * *